US010247039B2

(12) United States Patent
Rosset et al.

(10) Patent No.: US 10,247,039 B2
(45) Date of Patent: Apr. 2, 2019

(54) LOCKING OF BLADE-SUPPORTING COMPONENTS

(71) Applicant: SNECMA, Paris (FR)

(72) Inventors: Patrice Jean-Marie Rosset, Moissy-Cramayel (FR); Coralie Guerard, Moissy-Cramayel (FR); Helene Condat, Moissy-Cramayel (FR); Sebatien Prestel, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 484 days.

(21) Appl. No.: 14/911,424

(22) PCT Filed: Aug. 11, 2014

(86) PCT No.: PCT/FR2014/052079

§ 371 (c)(1),
(2) Date: Apr. 25, 2016

(87) PCT Pub. No.: WO2015/022468

PCT Pub. Date: Feb. 19, 2015

(65) Prior Publication Data

US 2016/0245122 A1 Aug. 25, 2016

(30) Foreign Application Priority Data

Aug. 13, 2013 (FR) ..... 13 57982

(51) Int. Cl.
*F01D 25/24* (2006.01)
*F01D 9/04* (2006.01)

(52) U.S. Cl.
CPC ..... *F01D 25/246* (2013.01); *F01D 9/042* (2013.01); *F05D 2220/32* (2013.01);
(Continued)

(58) Field of Classification Search
CPC ..... F01D 25/246; F01D 9/042
See application file for complete search history.

(56) References Cited

U.S. PATENT DOCUMENTS 5,197,853 A * 3/1993 Creevy ..... F01D 11/005 29/889.22
5,201,846 A * 4/1993 Sweeney ..... F01D 9/04 415/170.1

(Continued)

FOREIGN PATENT DOCUMENTS

EP 0959230 A2 * 11/1999 ..... F01D 9/04
EP 0967364 12/1999

(Continued)

OTHER PUBLICATIONS

International Search Report and Written Opinion with English Language Translation, dated Jan. 16, 2015, Application No. PCT/FR2014/052079.

(Continued)

*Primary Examiner* — Woody A Lee, Jr.
(74) *Attorney, Agent, or Firm* — Womble Bond Dickinson (US) LLP

(57) ABSTRACT

The invention relates to an assembly which includes: two rotationally symmetrical components (10, 20) for supporting the blades of a turbine engine, arranged one inside the other concentrically about a turbine engine axis, and a system (30) for locking the components (10, 20) such as to prevent the relative translation of same in the axial and radial directions relative to said axis, the system including a slotted ring (40) comprising a U-shaped cross-section suitable for receiving one end of the components (10, 20), the assembly being characterized in that the ring (40) and one of the components (10, 20) are shaped such as to allow the ring to be interlocked on the component, and in that the locking system (30) also includes a member for stopping the rotation of the ring (Continued)

relative to the component with which the latter is interlocked. The invention further relates to a method for assembling such an assembly.

12 Claims, 7 Drawing Sheets

(52) U.S. Cl.
CPC .... *F05D 2230/64* (2013.01); *F05D 2240/128* (2013.01); *F05D 2240/80* (2013.01); *F05D 2260/30* (2013.01); *F05D 2260/36* (2013.01)

(56) References Cited

U.S. PATENT DOCUMENTS 5,775,874 A 7/1998 Boite
6,200,091 B1 * 3/2001 Bromann ..... F01D 11/18 415/173.1
8,182,202 B2 5/2012 Bart et al.
9,828,879 B2 * 11/2017 Sluyter ..... F01D 25/246
2005/0141989 A1 * 6/2005 Sayegh ..... F01D 9/04 415/116
2007/0031245 A1 * 2/2007 Ruthemeyer ..... F01D 9/04 415/134
2016/0017738 A1 * 1/2016 Rogers ..... F02C 7/28 415/214.1
2016/0333740 A1 * 11/2016 Sluyter ..... F01D 11/08

FOREIGN PATENT DOCUMENTS

EP 1099826 5/2001
EP 2039885 3/2009
JP 2001073710 A * 3/2001 ..... F01D 25/246
JP 2007046603 A * 2/2007 ..... F01D 9/04
WO WO-2009138443 11/2009

OTHER PUBLICATIONS

French Search Report and Written Opinion, dated May 6, 2014, French Application No. 1357982.

* cited by examiner

LOCKING OF BLADE-SUPPORTING COMPONENTS

FIELD OF THE INVENTION

The invention relates to an assembly allowing locking in relative translation of two blade-supporting parts of a turbine engine such as for example a fixed blading platform and a blade-supporting ring or a mobile blading ring and a ring case.

The invention notably applies to locking of a blading platform for distributing a turbine engine flow to a supporting ring of said distribution blading.

STATE OF THE ART

An exemplary turbine engine was illustrated in FIG. 5.

A turbine engine 1 typically includes a nacelle which forms an aperture for intake of a determined air flow towards the engine strictly speaking. Generally, the turbine engine comprises one or several sections 3 for compressing the air admitted into the engine (generally a low pressure section and a high pressure section). The thereby compressed air is admitted into the combustion chamber 5 and mixed with fuel before being burnt therein.

The hot combustion gases from this combustion are then expanded in different turbine stages. A first expansion is accomplished in a high pressure stage 6 immediately downstream from the combustion chamber and which receives the gases at the highest temperature. The gases are again expanded while being guided through the so called low pressure turbine stages 7.

A high pressure 6 or low pressure 7 turbine conventionally includes one or several stages, each consisting of a row of fixed turbine blades, also called a distributor, followed by a row of mobile turbine blades, which form the rotor. The distributors are attached together via a ring. The distributor 2 deflects the gas flow taken at the combustion chamber towards the mobile turbine blades at a suitable angle and velocity in order to drive into rotation these mobile blades and the rotor of the turbine.

Each distributor is sectorized, i.e. formed with several distributor sectors positioned circumferentially end to end around a longitudinal axis X-X of the turbine engine. Each distributor sector comprises a plurality of blades extending radially relatively to the X-X axis of the turbine engine so as to connect a radially internal ring element (or internal platform) and a radially external ring element (or external platform), which form together an annular vein facing the mobile blades of the turbine.

On the external platform of the distributor is mounted a ring for supporting the distributor, which is an axisymmetrical part around the axis of the turbine engine.

The ring and the distributor have to be secured to each other. In this respect, means for blocking relative translation in the axial or radial direction (with respect to the axis of the turbine engine) have to be provided.

Locks applied in a similar way to a case section of turbine engine extending around a mobile blading ring are known from document FR 2 887 920.

The locks have the shape of crown sectors having a U-shaped cross-section in order to be able to receive a downstream end of the ring and of a distributor sector, each lock being mounted tightly, i.e. without any play, on the ring and the case in order to maintain them secured to each other.

This solution however is not transposable to the locking of a distributor platform (i.e. fixed blading) to a ring for supporting this distributor because of the too large mechanical and thermal stresses in these parts, respectively resulting from the forces of the air flow on the distributor and from the thermal expansion of the parts.

Indeed, in the case of tightening a lock on the parts, the lack of play between the lock on the one hand and the distributor and the ring on the other hand implies that the stresses in the parts are expressed by significant forces applied on the lock, causing deformation and fast degradation of the latter.

Therefore there exists a need for a system with increased lifetime, allowing the blocking of a distributor ring with an external distributor platform.

PRESENTATION OF THE INVENTION

The object of the invention is to overcome the problem mentioned herein before.

In particular, an object of the invention is to propose an assembly giving the possibility of maintaining together two blade-supporting parts of a turbine engine in a reliable way while having a long lifetime.

Another object of the invention is to propose an assembly which is easy to mount.

In this respect, the object of the invention is an assembly comprising:

- two turbine engine blading supporting parts, the parts being axisymmetrical, positioned one inside the other in a concentric way around a turbine engine axis, and
- a system for locking the parts for preventing their relative translation in the axial and radial directions with respect to said axis, the locking system comprising a split crown including a U-shaped cross-section adapted for receiving one end of both parts, the assembly being characterized in that the crown and one of the parts are conformed so as to allow engagement by clutching of the crown on the part, and in that the locking system further comprises a member for stopping the rotation of the crown relatively to the part with which it is engaged by clutching.

Advantageously, but optionally, the invention further includes at least one of the following features:

- the internal part is a fixed blading platform or a blading ring, and the external part is a fixed blade-supporting ring or a ring case, respectively.
- the U-shaped section of the crown comprises two arms connected together by a transverse bar, such that each arm is found facing one of the parts when the crown receives the end of the parts, one of the arms and the part facing said arm has clutch teeth adapted for cooperating in order to allow engagement by clutching of the crown on said part.
- the external part and the arm facing said part are provided with clutch teeth.
- the member for stopping rotation comprises:
  - a hook positioned at the slot of the crown and adapted for receiving the end of both parts, the hook comprising, on an arm extending along one of the parts, a through-orifice forming a housing, and
  - an attachment pin of the hook, crossing the part along which extends the arm of the hook, said pin being received in the housing of the hook.
- The hook further includes a through-groove adjacent to the housing and opening on one hook side in order to allow the insertion of the pin into the housing through the groove.

The groove has convergent edges towards the housing in order to prevent exit of the pin once it is inserted into the housing.

The hook further includes a cavity adjacent to the housing, allowing elastic deformation of the hook upon inserting the pin into the housing.

The cavity has a width less than the width of the pin.

The arm of the hook extends along the external part and the pin crosses said part.

The object of the invention is also a turbine engine comprising such an assembly.

The object of the invention is also a method for mounting such an assembly comprising the steps of:

mounting both axisymmetrical parts one inside the other in a concentric way, bringing the split crown and engaging it by clutching on one of the parts, and positioning the member for stopping rotation of the crown relatively to the part.

Advantageously, but optionally, during this mounting method, the step for positioning the member for stopping rotation comprises the steps of:

positioning an anti-rotation pin through one of the parts, and positioning a hook at the of the slot of the crown, so as to receive the end of both parts, and to move the hook towards the parts so as to successively engage the pin into the groove and then into the housing of the hook.

DESCRIPTION OF THE FIGURES

Other features, objects and advantages of the present invention will become better apparent upon reading the detailed description which follows, and with reference to the appended drawings given as non-limiting examples and wherein.

DETAILED DESCRIPTION OF AT LEAST ONE EMBODIMENT OF THE INVENTION

Figure 3A:
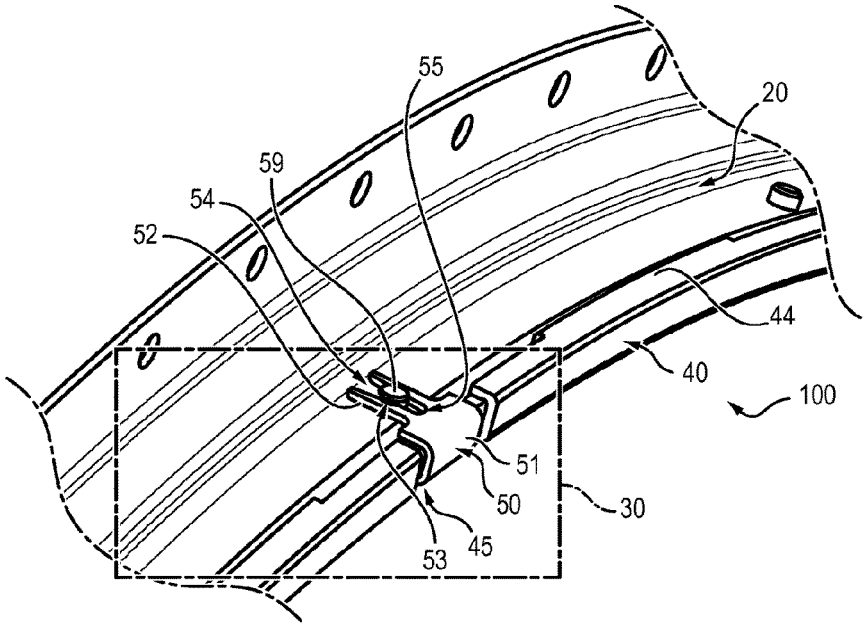
FIGS. 3*a* to 3*c* are views under different perspectives of an assembly according to an embodiment of the invention.
Figure 3B:
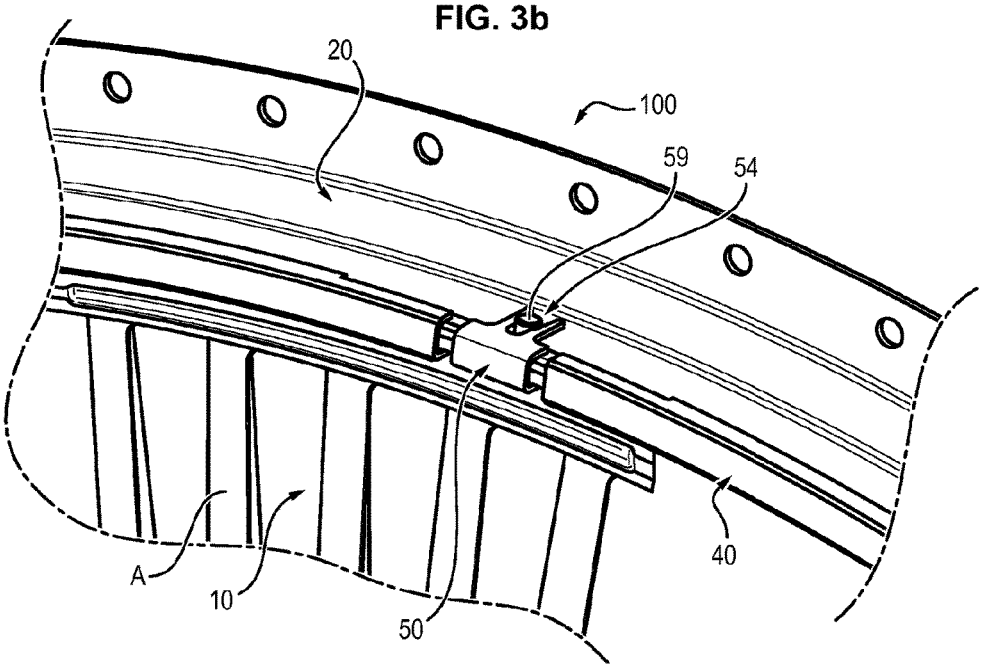
Figure 3C:
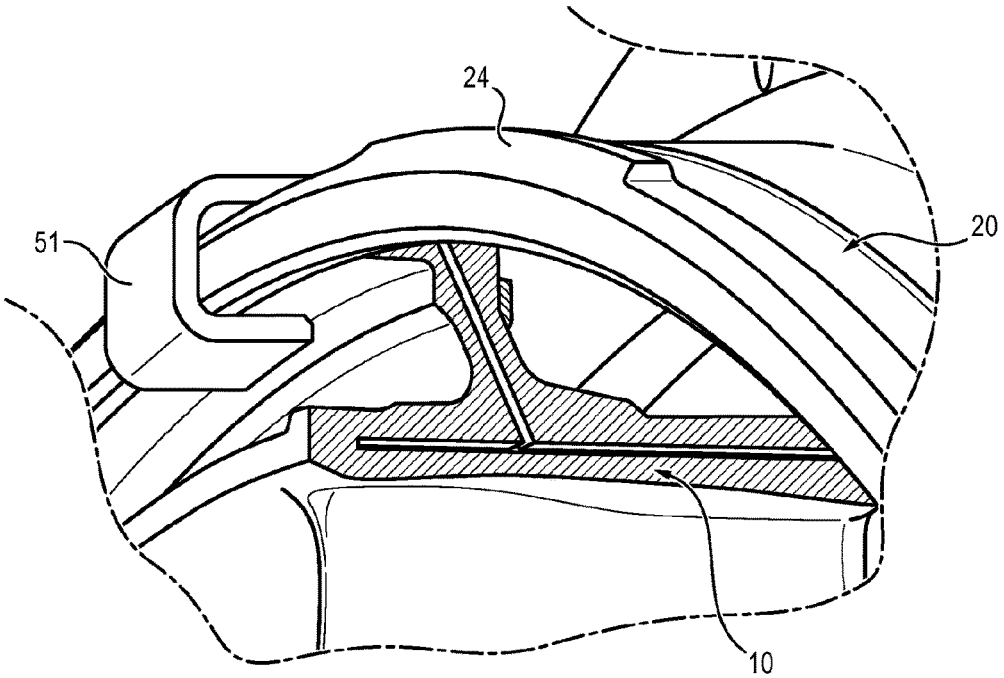
Figure 5:
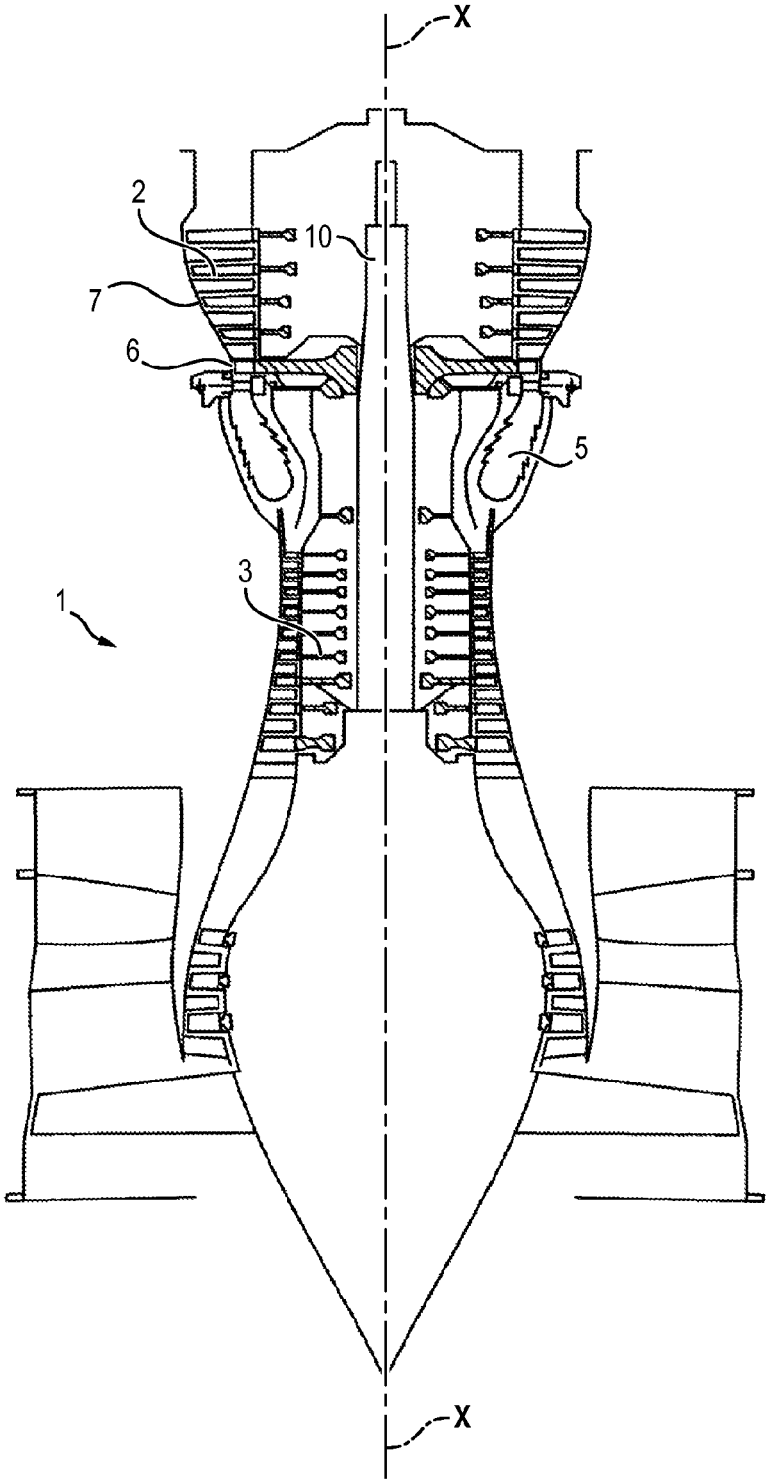
FIG. 5, already described, is a sectional view of a turbine engine example on which the assembly according to the invention may be applied.

With reference to FIG. 3*a*, an assembly 100 has been illustrated, which comprises two parts for supporting blading of a turbine engine, both parts being axisymmetrical, and positioned one inside the other in a concentric way around the axis XX of the turbine engine, visible in FIG. 5.

By part for supporting blading of a turbine engine, is meant:

in the case of fixed blading, for example blading for distributing flow: an external blading platform connecting together the blades of the blading, or a blade supporting ring, which is positioned around said platform, or further a blading ring case, positioned around said ring.

in the case of mobile blading, for example a compressor blading: a ring surrounding the blading, or a ring case, which is positioned around said ring.

The assembly 100 therefore comprises two blade-supporting parts, one radially internal part 10 and a radially external part 20 positioned around the first part.

According to a preferred embodiment, the internal part 10 is a fixed blading platform of a turbine engine like a flow distribution blading (also called a distributor), the external part 20 then being a fixed blade-supporting ring.

According to an alternative embodiment, the internal part 10 is a mobile blading ring, and the external part 20 is then a ring case.

According to another alternative, the internal part 10 is a fixed blade-supporting ring and the external part 20 is a ring case.

Figure 1A:
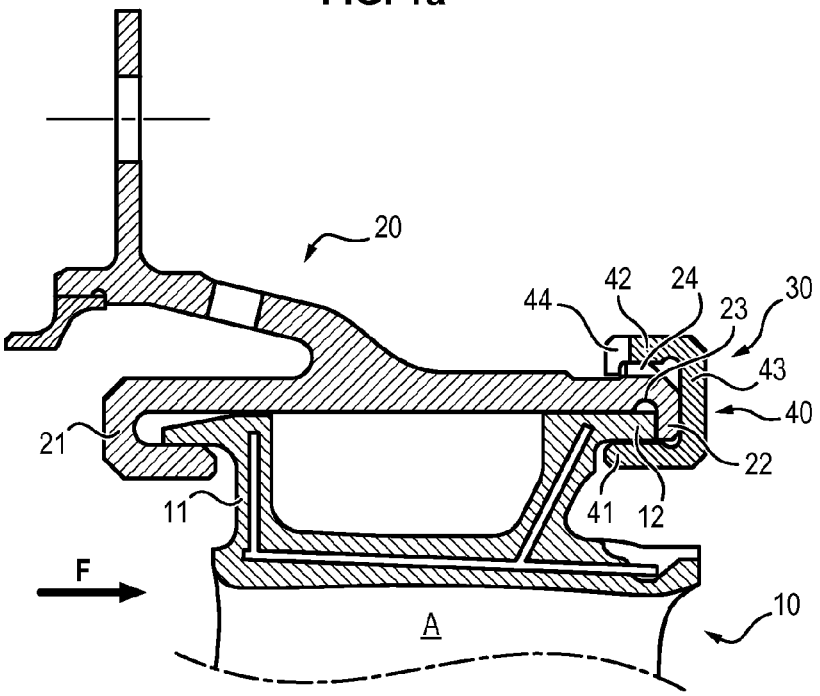
FIGS. 1*a* and 1*b* represent a transverse sectional view of an assembly according to an embodiment, respectively at a clutch tooth and at a member for stopping rotation of the crown on the parts.
Figure 1B:
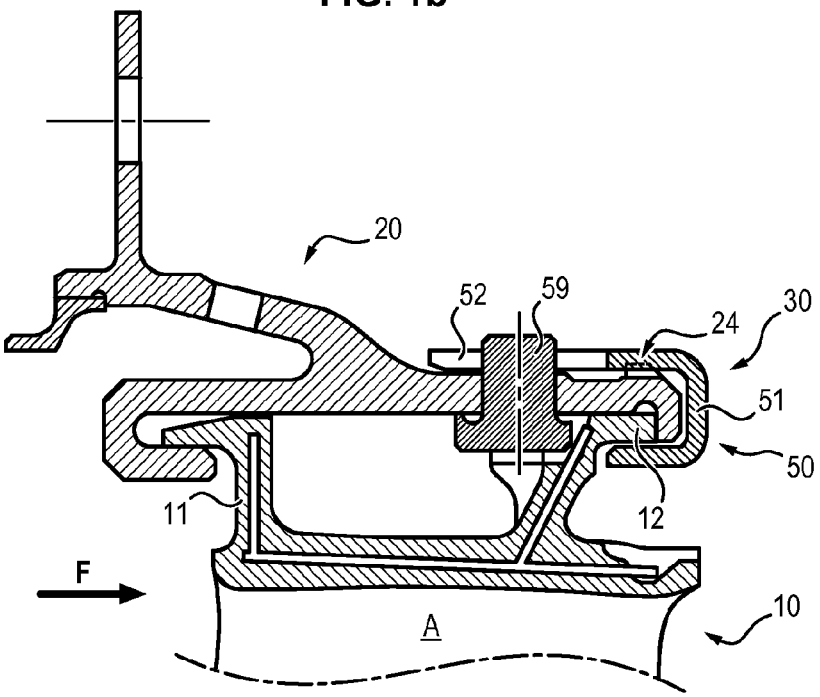

In FIGS. 1*a* and 1*b*, the assembly 100 has been illustrated in the first case. The internal part 10 is a blading platform, one blade A of which has been illustrated. The platform 10 comprises an upstream spoiler 11 and a downstream spoiler 12 relatively to the air flow, illustrated in the figure by an arrow F. The upstream 11 and downstream 12 spoilers respectively form the upstream and downstream ends of the platform.

The ring 20 for supporting the blading as for it comprises at its upstream end, a U-shaped hook 21 adapted for receiving the upstream spoiler 11 of the platform, and at its downstream end an edge 22 extending towards the axis and giving the possibility of retaining the downstream spoiler of the platform axially towards the downstream portion.

The edge 22 is provided with a notch 23 adapted so as to be able to cause pivoting of the corner of the downstream spoiler 12 in this notch during the positioning of the ring 20 on the platform. The ring support thus pivots around the platform (the pivot being at the downstream spoiler), and will receive the upstream spoiler at the hook 21. An axial play between the hook 21 and the upstream spoiler 11 results from this once the ring is found in position on the platform 10.

Further, as visible in the figures, at the edge 22 the downstream spoiler 11 is not retained radially.

Figure 1C:
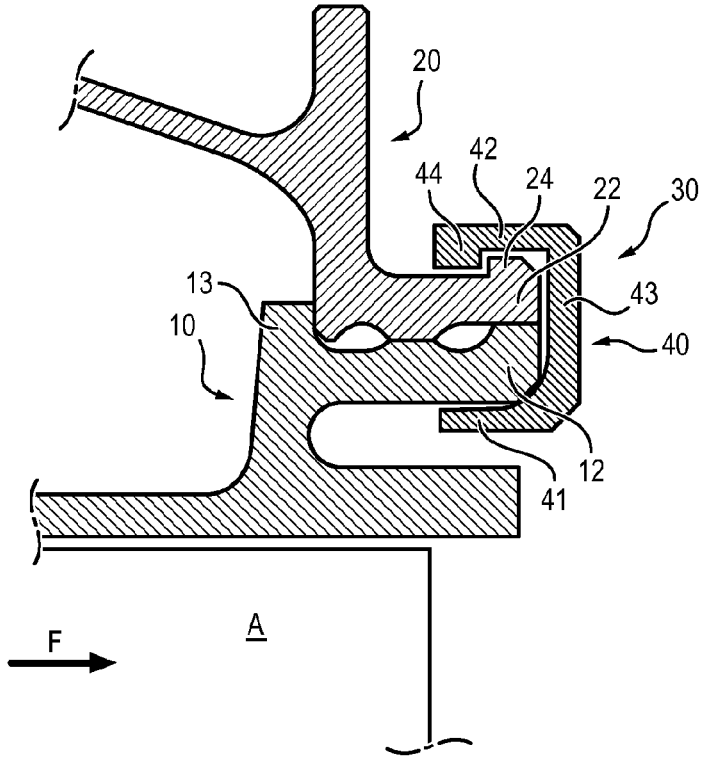
FIG. 1*c* represents a transverse sectional view of an assembly according to another embodiment, at a clutch tooth.

In the case when the internal part 10 is a mobile blading ring, and when the external part 20 is a ring case, with reference to FIG. 1*c*, the ring case 20 includes downstream circumferential edges 22 which are positioned facing downstream circumferential edges 12 of the blading ring 10.

A protrusion 13 on said edge gives the possibility of preventing displacement of the case towards the upstream portion with respect to the blading ring 10. However in the direction opposite to the downstream direction, and in the radial direction, the relative movements of the case 20 and of the blading ring 10 are not blocked.

The assembly 100 therefore comprises a system 30 for locking the parts in order to prevent their axial and radial relative translation (with respect to the axis of the turbine engine).

As visible more particularly in FIGS. 2*b* and 3*a* to 3*c*, this system 30 comprises a crown 40 having a U-shaped section comprising two parallel arms 41, 42, connected together at one end by a transverse bar 43.

The length of the transverse bar 43 defines the distance between the arms which should be sufficient for receiving one end of both parts 10, 20. In the case when the parts are respectively a blading platform and a supporting ring, the crown receives, as illustrated in FIGS. 1*a* and 1*b*, the downstream spoiler 12 of the platform and the edge 22 of the ring, so that an internal arm 41 of the crown is facing an internal face of the downstream spoiler 12 and an external arm 42 is facing the external face of the ring.

In FIG. 1*c*, in the case of a blading ring 10 surrounded by a ring case 20, the crown receives the downstream circumferential edges 12, 22 of both parts, the internal arm 41 facing the internal face of the downstream edge 12 of the ring, and the external arm 42 facing the external face of the downstream edge 22 of the case.

Further, the crown 40 is conformed so as to be able to be mounted by clutching on one of the parts.

Advantageously, the crown 40 and one of the parts, preferably the external part 20 are conformed so as to be able to cooperate together by clutching. In this respect, they comprise complementary clutch teeth 44, 24, i.e. the clutch teeth of each part are of equal length and distributed at constant angular intervals, and the angular interval between two clutch teeth 24, 44 of a part corresponding to or being greater than the length of a clutch tooth 44, 24 of the other part.

According to a preferred embodiment, which is illustrated in FIGS. 1*a*, 1*c*, 2*b* and 3*a*, the clutch teeth 44 are protrusions of the external arm 42 of the crown, which protrude inwards, i.e. towards the axis of revolution of the crown.

On the other hand, the external part 20 comprises on its external surface clutch teeth 24, which extend radially in the direction opposite to the axis of revolution of the part.

The crown may thus be mounted by clutching on the parts 10, 20 by receiving the end of both parts, which gives the possibility of ensuring stopping in translation along the radial direction of both parts 10, 20 relatively to each other (since the internal part 10 is maintained by the crown against the external part), and in axial relative translation, since the clutch teeth 44 and the transverse bar 43 of the crown deprive the external part 20 of any axial movement.

Further, the mounting by clutching of the crown on the parts gives the possibility of allowing for the presence of plays between the crown and the parts 10, 20, which allow the parts to expand, notably because of thermal constraints set into play, without reducing their lifetime.

Further, the lack of tightening implies that the crown should not support significant mechanical stresses. This allows reduction in the dimensioning of the crown, and therefore reduction in the size and the mass of the crown, which lightens the mass of the assembly of the turbine engine in which the parts 10, 20 are installed.

Figure 1D:
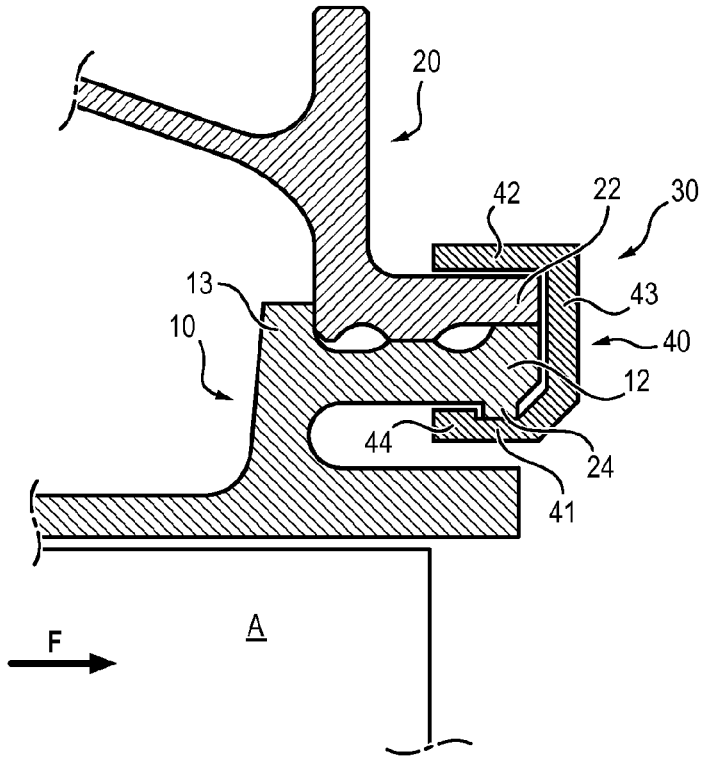
FIG. 1*d* represents a transverse sectional view of an assembly according to another embodiment, at a clutch tooth.
Figure 2A:
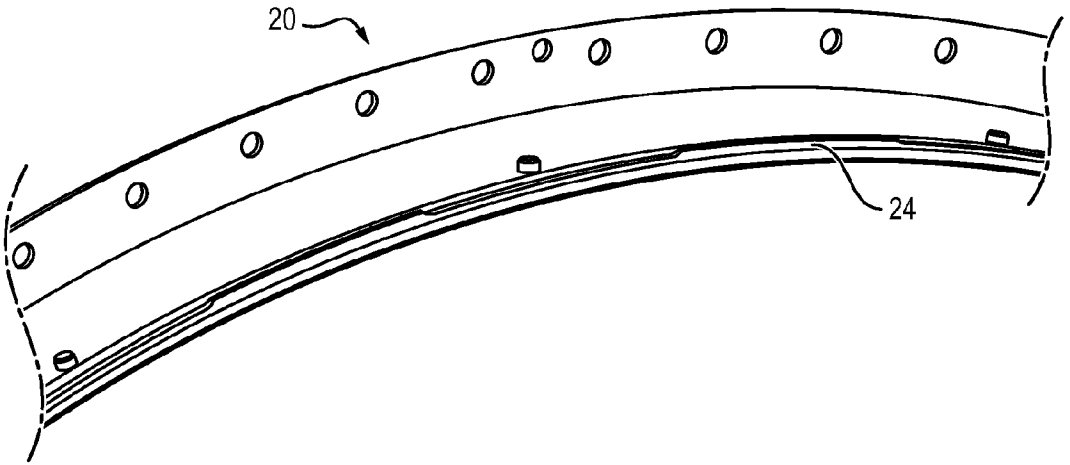
FIG. 2*a* represents a partial perspective view of a blade supporting ring which may be part of the assembly illustrated in FIGS. 1*a* and 1*b*.
Figure 2B:
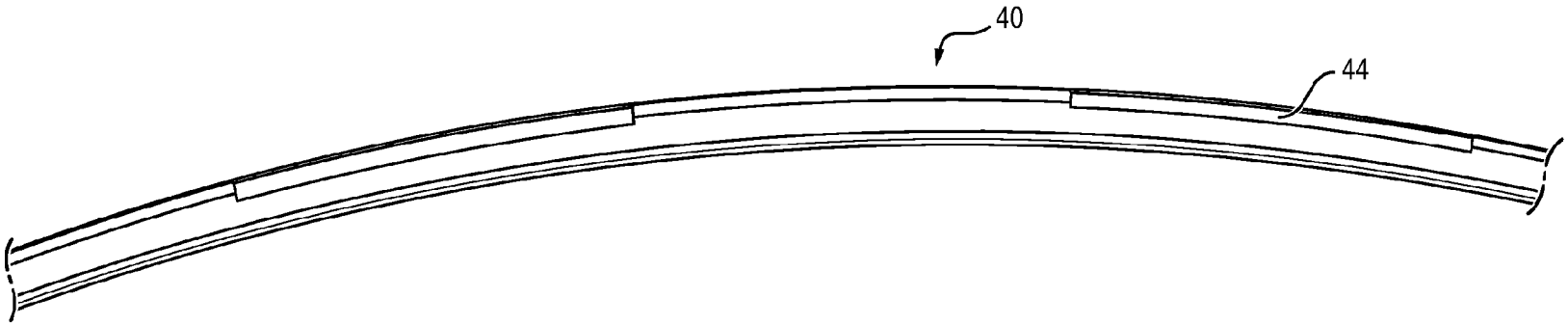
FIG. 2*b* represents a partial front view of a crown for locking the parts.

According to an alternative embodiment illustrated in FIG. 1*d*, the internal part 10 may comprise clutch teeth, positioned on its radially internal surface and extending radially. The crown 40 then comprises clutch teeth 44 on its internal arm 41, the teeth then protruding outwards.

The crown 40 is advantageously split, i.e. it extends over an angular sector of less than 360°, but advantageously greater than 350°. The slot 45 of the crown 40 also gives the possibility to the parts of expanding in the case of thermal constraints without damaging the crown or the actual parts.

The system 30 for locking the parts further comprises a member 50 for stopping rotation of the crown 40 relatively to both parts 10, 20. This rotation stopping member is advantageously positioned at the slot 45 of the crown 40.

As illustrated in FIGS. 1*b* and 3*a* to 3*c*, the rotation stopping member 50 comprises a hook 51 which is adapted for receiving the end of both parts 10, 20. In the case when the parts are a fixed blading platform 10 and a supporting ring 20, the ends are as earlier the end of the downstream spoiler 12 and of the edge 22.

In the case when the parts are a mobile blading ring 10 and a ring case, the ends are their downstream circumferential edges 12, 22.

The hook 51 in particular comprises an arm 52 extending along one of the parts 10, 20, advantageously along the external part 20. The arm 52 comprises a through-orifice 53 forming a housing for a pin 59 extending through an orifice (not shown) provided in the part along which extends the arm.

The orifice 53 advantageously has the same shape as the section of the pin 59, i.e. advantageously a circular shape.

When the crown 40 is mounted on the parts by clutching, it is positioned so that the clutch teeth 24, 44 face each other and that the crown thereby fulfils its role of radial and axial stop.

In this position, the hook 51 is mounted at the slot 45 for receiving the parts, and the pin 59 is inserted into the housing 53 of the hook, thereby maintaining the angular position of the hook of the crown 40 constant. The result of this is that, as the hook 51 occupies the slot 45 of the crown, the latter cannot pivot around the parts 10, 20 until the clutch teeth are no longer facing each other and the crown 40 may be removed.

Figure 3D:
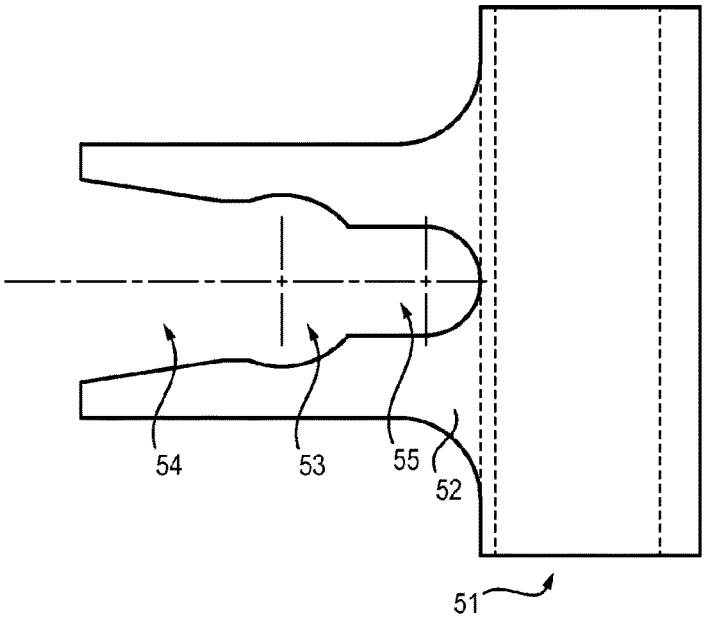
FIG. 3*d* represents a hook used for stopping rotation of a crown.

As more specifically visible in FIG. 3*a* and FIG. 3*d*, the hook 51 further includes a through-groove 54 adjacent to the housing 53, and opening onto one of the sides of the hook. In this way, the pin may be inserted into the housing by sliding it into the groove until it arrives into the housing 53.

The groove preferably has edges which converge towards the housing, the housing itself having a diameter greater than the distance between the edges of the groove at its end adjacent to the housing, so that the pin, once it is inserted into the housing by displacement in the groove, can no longer come out.

This requires slight deformation of the hook, at the edges of the groove 54, at the moment of the passing of the pin 59 in order to allow it through.

The hook 51 then advantageously includes a cavity 55, preferably a through-cavity, and adjacent to the housing, this cavity 55 being preferably found opposite to the groove with respect to the housing, thus allowing the hook 51 to elastically deform upon inserting the pin 59 into the housing 53.

This cavity 55 advantageously has a width smaller than the diameter of the housing 53, in order to prevent a displacement of the pin from the housing 53 to the cavity 55 once it is inserted into the housing 53.

Figure 4:
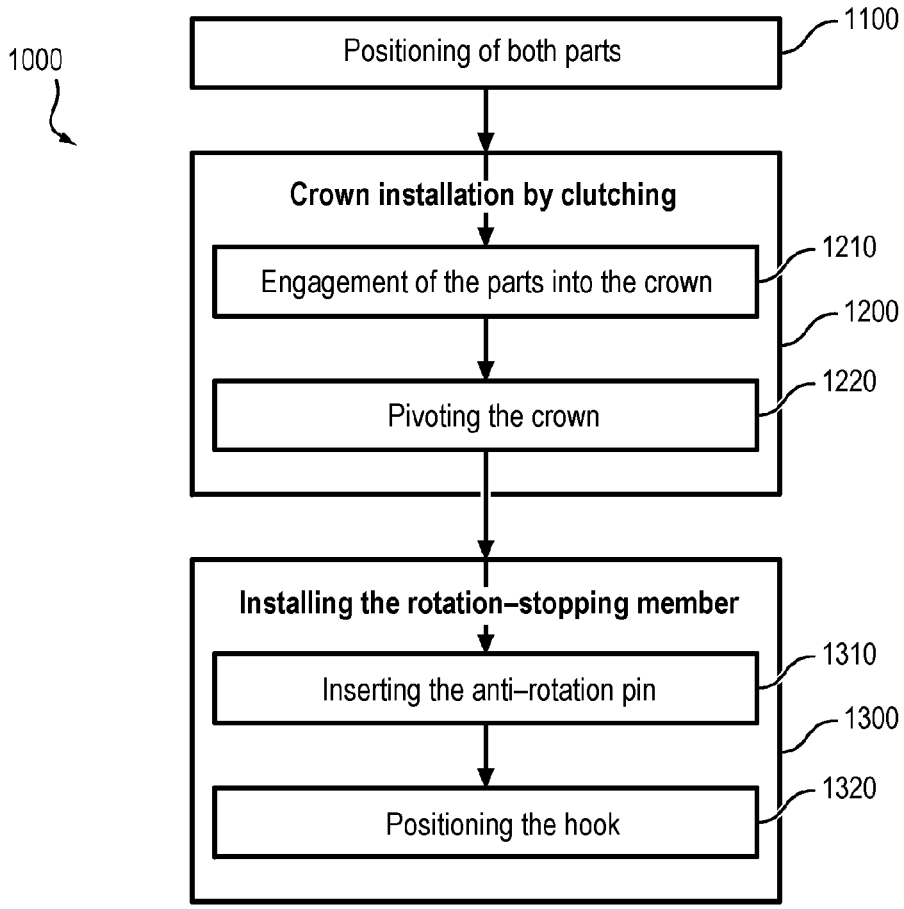
FIG. 4 schematically represents the main steps of the method for mounting an assembly according to the invention.

The main steps of the method 1000 for mounting the assembly 100 described earlier will now be described with reference to FIG. 4.

During a first step 1100, both parts of the blading support 10, 20 are positioned one inside the other in a concentric way. The parts are fitted together in a way known to one skilled in the art, for obtaining the arrangements respectively illustrated in FIGS. 1*a*, 1*b* in one case and 1*c* in the other case.

A crown 40 is then positioned 1200 by clutching on the parts. To do this, a crown 40 is brought 1210 by shifting the clutch teeth 44 of the crown relatively to the clutch teeth 24 of one of the parts, and by engaging the crown 40 into the parts so that the ends of the parts are received between the arms 41, 42 of the crown.

Next the crown 40 is pivoted 1220 relatively to the parts 10, 20 so that the clutch teeth 44 of the crown will face the clutch teeth 24 of the part, for example the external part 20, and the crown thereby forms an abutment in axial translation of the part.

Finally, during a step 1300, a member 50 for stopping the rotation of the crown relatively to the parts is positioned.

To do this, a hook 51 is preferably provided comprising a groove 54 adjacent to the housing 53. An anti-rotation pin 59 is engaged 1310 through one of the parts, and the hook 51 is brought 1320 at the slot, so that it receives the end of the parts and the pin 59 is received in the groove. The hook 51 is gradually moved so that the pin 59 moves in the groove until it attends the housing 53.

The pin 59 is found advantageously blocked in the housing by the convergent edges of the groove.

Thus an assembly has been proposed allowing locking in axial and radial translation of two blade supporting parts of a turbine engine, which has a substantial lifetime and which is simple to mount.

The invention claimed is:

1. An assembly comprising:

two blade-supporting parts of a turbine engine, the parts being axisymmetrical and comprising an internal part and an external part, the internal part being positioned inside the external part in a concentric way around a turbine engine axis, and a system for locking the internal and external parts in order to prevent their relative translation in the axial and radial directions with respect to said axis, the locking system comprising a split crown including a U-shape cross-section adapted for receiving an end of both parts, the U-shape section of the crown comprising two arms connected together by a transverse bar, such that each arm is found facing one of the internal and external parts when the crown receives an end of the internal and external parts, the assembly being characterized in that one of the arms of the crown and the internal or external part facing said arm being toothed with clutch teeth adapted for cooperating so as to allow engagement by clutching of the crown on said toothed internal or external part, during which:

the crown is engaged with the internal and external parts so that the ends of the parts are received between the arms of the crown, the clutch teeth of the crown being shifted relatively to the clutch teeth of said toothed internal or external part, the crown is then pivoted relatively to the internal and external parts so that the clutch teeth of the crown will face the clutch teeth of said toothed internal or external part and that the crown thereby forms an axial translation abutment of said toothed internal or external part, and in that the locking system further comprises a member for stopping rotation of the crown relatively to said toothed internal or external part with which it is engaged by clutching.

2. The assembly according to claim 1, wherein the internal part is a fixed blading platform or a blading ring, and the external part is a fixed blade-supporting ring or a ring case, respectively.

3. The assembly according to claim 1, wherein the external part and the arm facing said external part are provided with clutch teeth.

4. The assembly according to claim 1, wherein the member for stopping rotation comprises:

a hook positioned at the slot of the crown and adapted for receiving the end of both parts, the hook comprising an arm and on said arm a through-orifice forming a housing, a pin for attaching the hook and being received in the housing of the hook, wherein the arm of the hook extends along a selected one of the internal part and the external part, and the pin crosses said selected part.

5. The assembly according to claim 4, wherein the hook further includes a through-groove adjacent to the housing and opening onto one side of the hook in order to allow insertion of the pin into the housing through the groove.

6. The assembly according to claim 5, wherein the groove has edges converging towards the housing in order to prevent exit of the pin once it is inserted into the housing.

7. The assembly according to claim 4, wherein the hook further includes a cavity adjacent to the housing, allowing elastic deformation of the hook upon inserting the pin into the housing.

8. The assembly according to claim 7, wherein the cavity has a width smaller than the width of the pin.

9. The assembly according to claim 1, wherein the arm of the hook extends along the external part and the pin crosses said external part.

10. A turbine engine, comprising an assembly according to claim 1.

11. A method for mounting an assembly according to claim 9, comprising the steps of:

mounting the internal part inside the external part in a concentric way, bringing the split crown and engaging it by clutching on the toothed internal or external part, and positioning the member for stopping rotation of the crown relatively to the toothed internal or external part.

12. A method for mounting an assembly, said assembly including:

two blade-supporting parts of a turbine engine, the parts being axisymmetrical, and comprising an internal part and an external part, the internal part being positioned inside the external part in a concentric way around a turbine engine axis, and a system for locking the internal and external parts in order to prevent their relative translation in the axial and radial directions with respect to said axis, the locking system comprising a split crown including a U-shape cross-section adapted for receiving an end of both parts, the U-shape section of the crown comprising two arms connected together by a transverse bar, such that each arm is found facing one of the internal and external parts when the crown receives an end of the internal and external parts, the assembly being characterized in that one of the arms of the crown and the internal or external part facing said arm being toothed with clutch teeth adapted for cooperating so as to allow engagement by clutching of the crown on said toothed internal or external part, during which:

the crown is engaged with the internal and external parts so that the ends of the parts are received between the arms of the crown, the clutch teeth of the crown being shifted relatively to the clutch teeth of said toothed internal or external part, the crown is then pivoted relatively to the internal and external parts so that the clutch teeth of the crown will face the clutch teeth of said toothed part and that the crown thereby forms an axial translation abutment of said toothed internal or external part, and the locking system further comprises a member for stopping rotation of the crown relatively to said toothed internal or external part with which it is engaged by clutching, wherein the member for stopping rotation includes:

a hook positioned at the slot of the crown and adapted for receiving the end of both parts, the hook comprising an arm and on said arm a through-orifice forming a housing, and a pin for attaching the hook and being received in the housing of the hook and the arm of the hook extends along a selected one of the internal part and the external part, and the pin crosses said selected part, wherein the hook further includes a through-groove adjacent to the housing and opening onto one side of the hook in order to allow insertion of the pin into the housing through the groove, the method comprising the steps of:

mounting the internal part inside the external part in a concentric way, bringing the split crown and engaging it by clutching on the toothed internal or external part, positioning the member for stopping rotation of the crown relatively to the toothed internal or external part, wherein the step for positioning comprises the steps of:

positioning an anti-rotation pin through said selected part, and positioning the hook at the slot of the crown, so as to receive the end of both parts, and displacing the hook towards the internal and external parts so as to successively engage the pin into the groove and then into the housing of the hook.

* * * * *